US005135353A

United States Patent [19]

Westhoff et al.

[11] Patent Number: 5,135,353

[45] Date of Patent: Aug. 4, 1992

[54] VARIABLE PRESSURE PITOT PUMP WITH REDUCED HEATING OF PUMPED FLUID

[75] Inventors: Paul E. Westhoff, Chana; Kent I. M. Weber, Rockford, both of Ill.

[73] Assignee: Sundstrand Corporation, Rockford, Ill.

[21] Appl. No.: 682,538

[22] Filed: Apr. 9, 1991

[51] Int. Cl.[5] ..... F04D 1/14

[52] U.S. Cl. ..... 415/88; 415/89; 415/177; 188/264 R; 310/62; 318/254

[58] Field of Search ..... 415/88, 89, 177, 179; 417/373; 188/267, 161, 162, 264 R, 264 A; 310/62, 63; 318/254

[56] References Cited

U.S. PATENT DOCUMENTS

| | | | |
|---|---|---|---|
| 2,440,624 | 4/1948 | Wemp | 415/89 |
| 3,512,618 | 5/1970 | Schafer | 188/161 |
| 3,791,757 | 2/1974 | Tarifa et al. | 415/89 |
| 3,925,042 | 12/1975 | Hutgens et al. | 415/179 |
| 4,073,596 | 2/1978 | Erickson et al. | 415/180 |
| 4,110,670 | 8/1978 | Araki et al. | 318/757 |
| 4,247,246 | 1/1981 | Abe et al. | 415/200 |
| 4,267,964 | 5/1981 | Williams | 415/88 |
| 4,281,962 | 8/1981 | Erickson | 415/89 |
| 4,339,923 | 7/1982 | Hays et al. | 415/88 |
| 4,367,717 | 12/1982 | Schippers et al. | 415/180 |
| 4,776,167 | 10/1988 | Kawamura | 415/177 |
| 4,788,463 | 11/1988 | Layh | 188/161 |
| 4,946,349 | 8/1990 | Manabe et al. | 415/89 |

FOREIGN PATENT DOCUMENTS

| | | | |
|---|---|---|---|
| 230159 | 11/1963 | Australia . | |
| 1513202 | 10/1989 | U.S.S.R. | 415/88 |

*Primary Examiner*—John T. Kwon

*Attorney, Agent, or Firm*—Antonelli, Terry, Stout & Kraus

[57] ABSTRACT

A variable pressure and variable flow rate pump in accordance with the invention includes a stationary pump housing (1), a rotating pump housing (10), rotatably mounted with respect to the stationary pump housing including a fluid receiving chamber (12) for receiving fluid to be pumped which is driven by a drive (11); a pitot probe (5) rotatably mounted in the stationary pump housing having a tip (5a) disposed in the fluid receiving chamber radially offset from an axis of rotation of the probe for receiving fluid from the fluid receiving chamber; a brake (15) for selectively braking a rotational speed of the probe to control the rotational speed of the probe independently of a rotational speed of the rotating pump housing to provide a fluid output from the output with a variable pressure and flow rate; a thermal insulator (44) mounted between the brake and the fluid receiving chamber for thermally insulating the fluid receiving chamber from heat generated by the brake; and a control (C) coupled to the brake for controlling activation of the brake to control a rate of rotation of the probe to control the pressure and flow rate of the fluid produced at the output.

22 Claims, 3 Drawing Sheets

VARIABLE PRESSURE PITOT PUMP WITH REDUCED HEATING OF PUMPED FLUID

DESCRIPTION

1. Technical Field

The present invention relates to a pitot pump which provides variable pressure and variable flow rates.

2. Background Art

In certain applications, such as a fuel pump for an aircraft, it is desirable to vary an output pressure and flow rate of a centrifugal pump independently of speed. In aircraft fuel pumps it is conventional practice to throttle, recirculate or bypass the flow of the pump so as to vary the output pressure and flow thereof. However, this approach results in unacceptably high fuel temperature rise due to poor efficiency.

U.S. Pat. Nos. 2,440,624, 3,791,757, 4,073,596, 4,281,962, 4,339,923 and Austrian Patent 230,159 disclose centrifugal pumps with rotating tubes. Pitot pumps have the advantage of reducing heating of fuel in aircraft applications which can be a severe problem with non-pitot pump fuel pumps where minimum flow conditions are encountered. Moreover, pitot pumps themselves are known to generate high internal heat levels during constant high speed operation of a pump. U.S. Pat. No. 4,073,596 discloses the cooling of the oil supply so that the lubricity of the oil applied to the bearings is not diminished by high temperatures which extends the life of the bearings.

In aircraft fuel pump applications it is extremely important to prevent the temperature of the fuel from exceeding a temperature limit. If the temperature limit is exceeded, fuel coking can rapidly occur which can cause malfunction or failure of combuster injection nozzles.

DISCLOSE OF INVENTION

U.S. patent application Ser. No. 605,424 entitled "Variable Pressure Pitot Pump" filed on Oct. 28, 1990 discloses an improved pitot pump having a preferred application of a fuel pump in an aircraft. FIG. 1 illustrates the pitot pump disclosed in Ser. No. 605,424. A fluid pump P is provided, including a stationary housing 1 and a rotating housing comprised of connected members 10 and 10*a*. The rotating housing 10, 10*a* rotates in response to torque applied from a rotary drive 11 about a rotational axis centered on the rotating housing 10, 10*a*. The stationary housing 1 includes a conventional bearing support 4 for a freely rotating pitot tube 5. An inlet seal 6, of a conventional construction, is provided at an inlet end of the stationary housing 1, with an outlet seal 7, also of conventional construction provided at the outlet end of the stationary housing. The pitot tube 5, which is rotatably journalled by bearings 4 in the stationary housing 1 terminates in a probe tip 5*a* disposed in a cylindrical chamber 12 defined by the rotating housing parts 10, 10*a*. The fluid to be pumped such as aircraft propulsion fuel is introduced into the chamber 12 through a fluid inlet port 2. A maximum pressure of the pump P is developed at the probe tip 5*a* and at the pump outlet 3 when the probe is prevented from rotating. When the probe 5 is permitted to rotate freely, rotational speed of the probe will be substantially equal to the rotational speed of the housing 10, 10*a* driven by the rotary drive 11. Consequently, very little pressure develops at the probe tip 5*a* and at the pump outlet 3. Control of the rotational speed of the probe 5 permits the probe to rotate at selected intermediate speeds to control the pump outlet pressure and flow rate. A brake 15, including a plurality of magnets 20, controls the rotational velocity of the probe 5. The magnets 20 are disposed about a periphery of an end of the probe 5 opposite the tip 5*a*. The coils are mounted in the stationary housing 1 in opposition to the magnets so that a magnetic field created by current flow through the coils 21 applies braking torque to the probe 5 through interaction of the magnetic field produced by the magnets 20 with the magnetic field produced by the coil 21. A controller C controls the current which is applied to the coil 21 in response to pressure or flow signals which are detected by a conventional sensor S which is coupled to the fluid pumped from the outlet 3 in a manner not illustrated. Furthermore, it should be understood that the aforementioned brake 15 alternatively may be a friction brake or a hydrodynamic brake which is controlled by the controller C in response to the sensed pressure or flow rate sensed by sensor S.

The pump P with the pitot probe 5 independently braked by the brake 15 provides a pumping mechanism for a low specific speed low NPSH (net positive suction head) application such as that required for an aircraft fuel pumping system. Varying the rotation of the probe 5 by activation of the brake 15 permits the pump to have a variable pressure and flow independent of the shaft speed produced by the rotary drive 11.

The pitot pump disclosed in U.S. patent application Ser. No. 605,428 has a disadvantage of coupling heat generated by the brake 15 to the fluid entering the inlet port 2 through thermal conductivity through the boundary wall 24. As a result, the temperature of the fuel flowing into the chamber 12 is raised to a point where the temperature of the pumped fuel at the outlet 3 could be at a temperature where coking would occur.

The present invention is an improvement of the pitot pump disclosed in Ser. No. 605,428 by providing a mechanism for minimizing the temperature rise of the pumped fluid caused by activation of the brake. With the invention, the stationary housing is split into two parts with thermal insulation being provided between the two parts. As a result, the flow of heat generated by the activation of the brake is minimized with a preferred application of the invention having only the pitot tube itself thermally connecting the two parts of the housing. As a result, a chamber is defined radially between an outside surface of the pitot tube which is filled with air which extends to an inner radius of the thermal insulation which is preferably annular with first and second ends of the annular thermal insulation being in contact with the first and second parts of the stationary housing. Furthermore, in accordance with the invention an air fan may be added to the brake to duct cooling air into contact with the brake to minimize the temperature rise in the brake to minimize the flow of heat between the first and second parts of the housing. Additionally, a heat exchanger may be coupled to the fluid outlet of the pump which is coupled to the cool air being drawn into contact with the brake to provide further cooling of the fluid pump from the outlet of the pump. As a result, the temperature of the pumped fluid provided by the pump may be minimized. However, in an application where the pump is used to pump propulsion fuel for an aircraft, it is desirable to minimize the temperature rise of the fuel, keeping it below the coking temperature. Therefore, the heat load represented by cooling of the fluid outputted by the pump should not produce a rise in the temperature of the air ducted into contact with the brake which results in the fuel temperature within the pump rising above the coking temperature.

A variable pressure and variable flow rate pump in accordance with the invention includes a stationary pump housing; a rotating pump housing rotatably mounted with respect to the stationary pump housing including a fuel receiving chamber for receiving fluid to be pumped which is driven by a drive; a pitot probe rotatably mounted in the stationary pump housing having a tip disposed in the fluid receiving chamber radially offset from an axis of rotation of the probe for receiving fluid from the fluid receiving chamber and having an output which outputs a fluid output from the probe; a brake for selectively braking a rotational speed of the probe to control the rotational speed of the probe independently of a rotational speed of the rotating pump housing to provide the fluid output from the output with a variable pressure and flow rate; a thermal insulator mounted between the brake and the fluid receiving chamber for thermally insulating the fluid receiving chamber from heat generated by the brake to minimize temperature rise in the fluid; and a control coupled to the brake for controlling activation of the brake to control a rate of rotation of the probe to control the pressure and flow rate of fluid produced at the output. The thermal insulator comprises an annulus having one end thermally coupled to the brake and another end thermally coupled to an outside surface of the fluid receiving chamber. The stationary pump housing comprises a first section in which the brake is disposed; a second section in which the fluid receiving chamber is disposed; and wherein the pitot probe is rotatably mounted in the first and second sections with the thermal insulator and the pitot probe defining a chamber extending radially from the probe to the insulator. A fan is rotatably driven by the probe for blowing air at a temperature cooler than the brake into contact with a surface thermally coupled to the brake for cooling the brake. A heat exchanger is coupled to air flowing to the fan which is cooler than the fluid outputted by the fan and to the fluid outputted by the output for cooling the fluid outputted by the output.

BEST MODE FOR CARRYING OUT THE INVENTION

Figure 1:
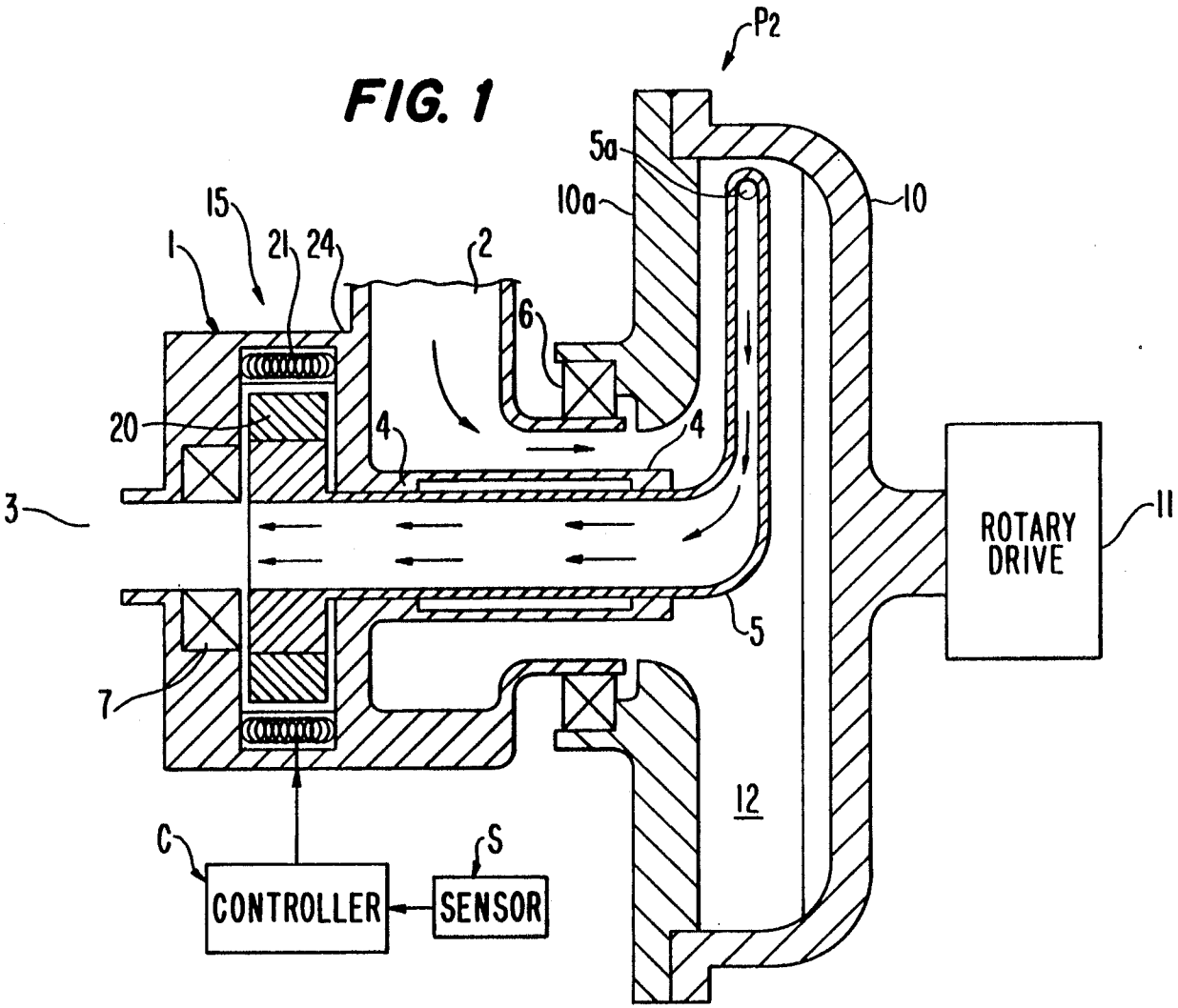
FIG. 1 illustrates a pitot pump having a brake for a pitot probe thermally coupled to a fluid receiving chamber.
Figure 2:
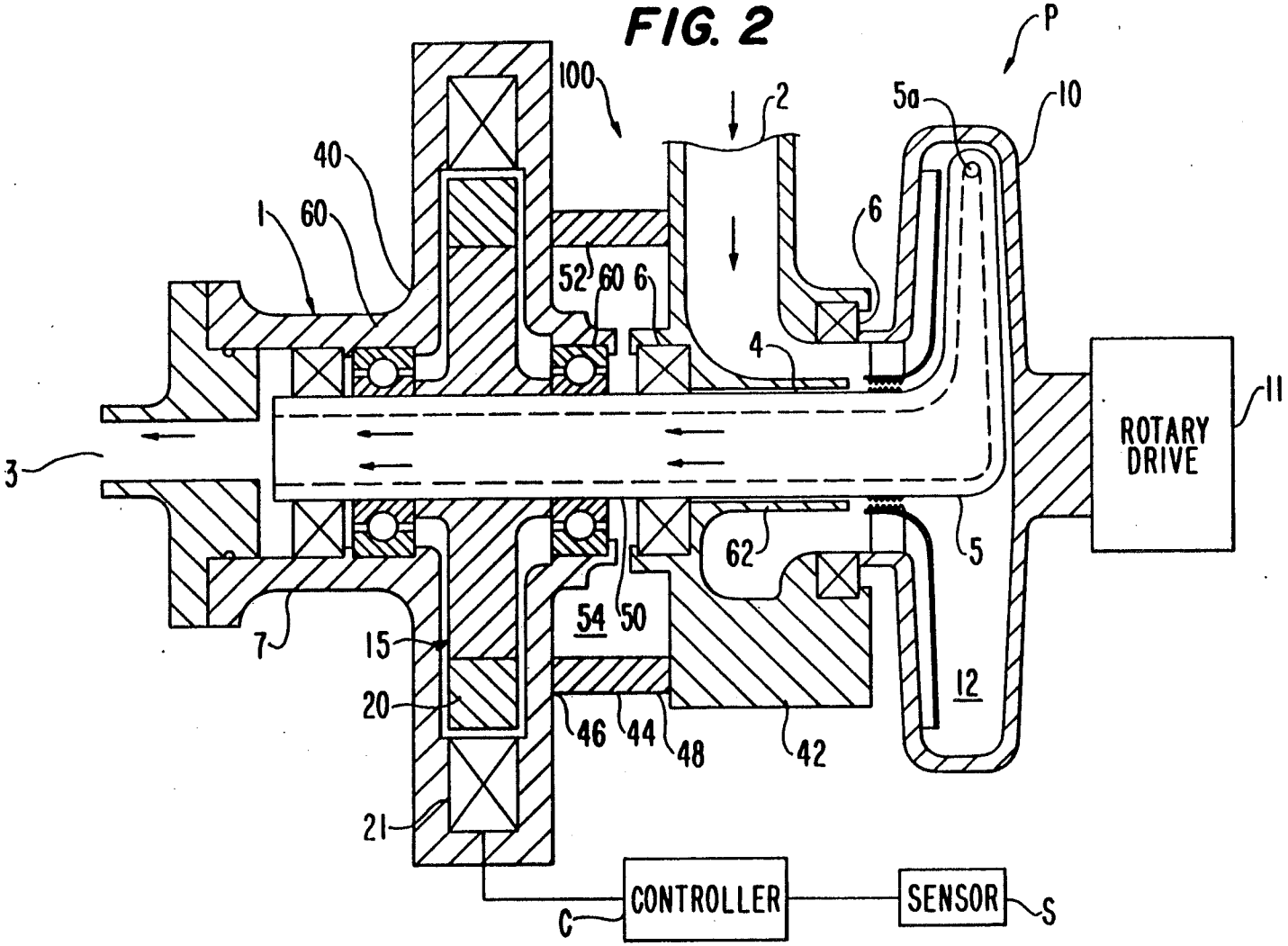
FIG. 2 illustrates a first embodiment of the present invention.

FIG. 2 illustrates a first embodiment of the present invention. Like reference numerals identify like parts throughout the drawings. The first embodiment 100 differs from the pitot pump illustrated in FIG. 1 in that the stationary housing 1 is split into a first section 40 and a second section 42 which are connected together by the pitot probe 5 and an annular insulator 44. A first end 46 of the annular insulator is in surface contact with the first section 40 and is thermally coupled to the brake 15. A second end 48 is thermally coupled to an outside surface of the fluid receiving chamber 12. The annulus 44 is chosen to have sufficient strength to provide structural support for the first and second sections 40 and 42 and further to provide a high degree of thermal insulation between heat generated by the operation of the brake 15 and the fluid receiving chamber 12 as a consequence of the chamber being filled with air. The outside surface 50 of the pitot probe 5 and the inside surface 52 define a radially extending chamber 54 which provides further insulation between heat generated by the operation of the brake 15 and the fluid receiving chamber 12 as a consequence of the chamber being filled with air. As a result of the insulation provided by the annulus 44 and the chamber 54, the temperature of the fluid being pumped entering the inlet 2 is prevented from being substantially raised by the operation of the brake in substantially retarding the rotation of the pitot probe 5.

The pitot probe 5 is rotatably supported in the first section 40 by a pair of roller bearings 60 and is rotatably supported in the second section 42 by a bushing 62. As a result, the probe 5 is freely rotatable within the stationary housing 1. The rotational speed of the pitot probe 5 is varied in accordance with the sensed pressure or flow rate sensed by sensor S which is applied to controller C which applies a control signal to the coil 21 to produce a desired pressure or flow rate at the output 3.

Moreover, like the pitot pump illustrated in FIG. 1, the magnetic brake 15 may be replaced with a friction brake or a hydraulic brake with suitable control of the braking provided by the combination of the sensor S and the controller C in a manner analogous to the magnetic braking provided by the magnetic brake 15.

Figure 3:
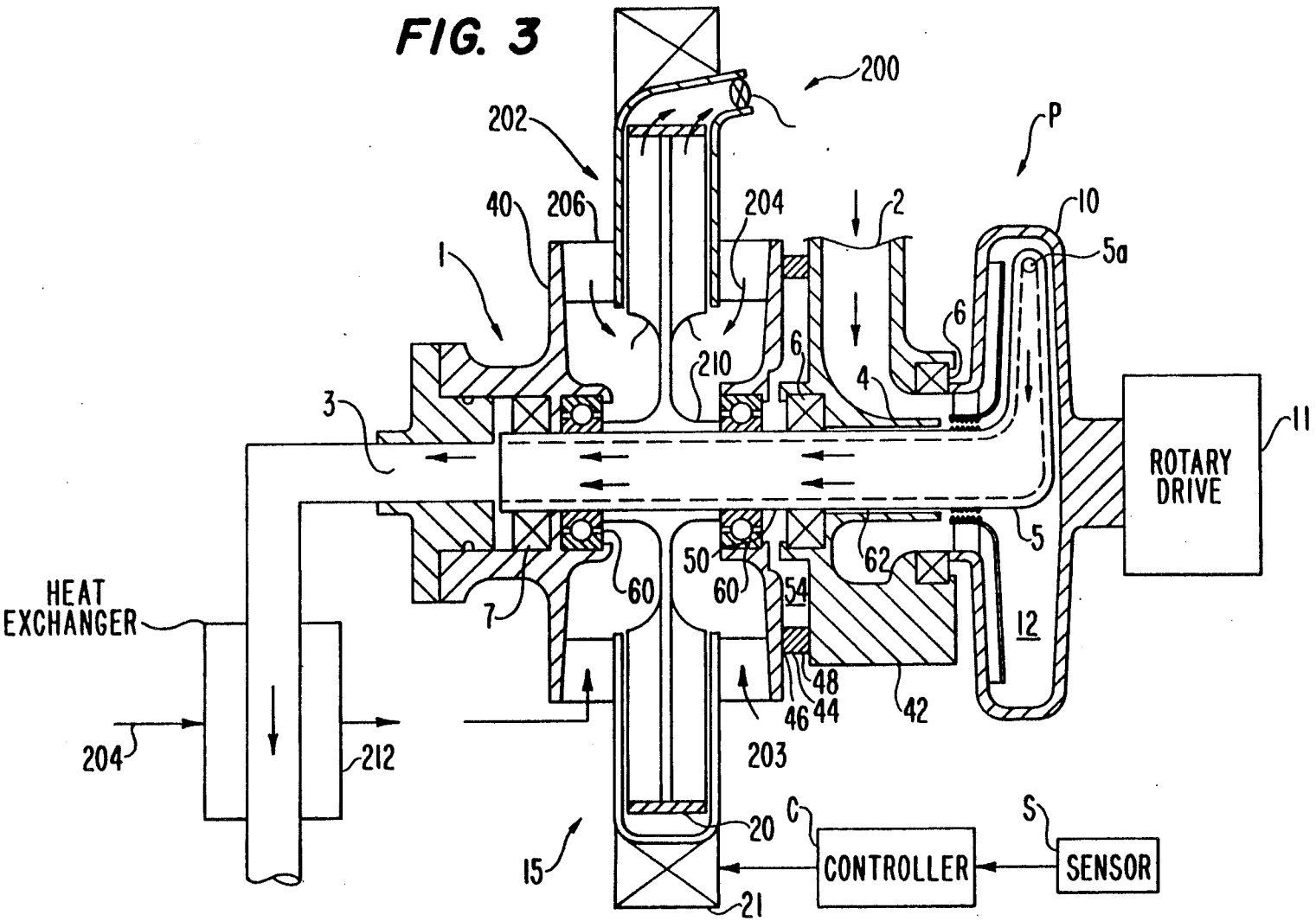
FIG. 3 illustrates a second embodiment of the present invention.

FIG. 3 illustrates a second embodiment 200 in accordance with the present invention. The second embodiment 200 differs from the first embodiment 100 illustrated in FIG. 2 in that a fan 202 rotatably driven by the pitot probe 5 blows air at a temperature cooler than the brake into contact with a surface thermally coupled to the brake for cooling the brake. The arrows 204 represent the flow of cooler air into the inlet 206 of the fan. A plurality of blades 208 are attached to a hub 210 which is joined to the pitot probe 5. The blades 208 work in a manner analogous to the fan mechanism on an exercise bicycle. The fan, together with a controlled discharge throttle or inlet guide vanes, can settle the braking function. The magnets 20 may be mounted on the tip of the blades 202 so as to interact with the magnetic field produced by the coil 21. A heat exchanger 212 may be optionally provided to cool the fuel pump from the outlet by contact with the cold air 204 which is drawn into the inlet 206 of the fan 202. However, it should be noted that the use of the heat exchanger 212 should only occur in circumstances where the temperature of the fuel pumped by the pump P is maintained below a temperature at which coking occurs. Cooling of the pumped fuel after it has been raised to a temperature where the onset of coking occurs is not advantageous with the desired mode of operation being to always maintain the temperature of the fuel below the coking temperature within the pump. However, if the cool air source providing the air 202 is sufficient to maintain the temperature of the brake 15 below a temperature at which the fluid would be heated to a temperature at which coking occurs, operation of the heat exchanger may be utilized without having a detrimental effect on the fluid being pumped. It should be understood that the heat exchanger 212 has been illustrated schematically with various physical configurations of a heat exchanger being possible including the heat exchanger being symmetrically disposed with regard to the inlet 206 of the fan.

While the invention has been described in terms of its preferred embodiments, it should be understood that numerous modifications may be made thereto without departing from the spirit and scope of the invention. It is intended that all such modifications fall within the scope of the appended claims. For example, while a preferred application of the present invention is the pumping of fuel to a propulsion engine in an aircraft, it should be understood that the invention is not limited thereto.

We claim:

1. A variable pressure and variable flow rate pump comprising:

a stationary pump housing;

a rotating pump housing rotatably mounted with respect to the stationary pump housing including a fluid receiving chamber for receiving fluid to be pumped which is driven by a drive mechanism;

a pitot probe rotatably mounted in the stationary pump housing having a tip disposed in the fluid receiving chamber radially offset from an axis of rotation of the probe for receiving fluid from the fluid receiving chamber and having an output;

a brake for selectively braking a rotational speed of the probe to control the rotational speed of the probe independently of a rotational speed of the rotating pump housing to provide the fluid output from the output with a variable pressure and flow rate;

a thermal insulator mounted between the brake and the fluid receiving chamber for thermally insulating the fluid receiving chamber from heat generated by the brake to minimize temperature rise in the fluid; and a control coupled to the brake for controlling activation of the brake to control a rate of rotation of the probe to control the pressure and flow rate of fluid produced at the output.

2. A pump in accordance with claim 1 wherein:

the thermal insulator comprises an annulus having one end thermally coupled to the brake and another end thermally coupled to an outside surface of the fluid receiving chamber.

3. A pump in accordance with claim 2 wherein the stationary pump housing comprises:

a first section in which the brake is disposed;

a second section in which the fluid receiving chamber is disposed; and wherein the pitot probe is rotatably mounted in the first and second sections with the thermal insulator and the pitot probe defining a chamber extending radially from the probe to the insulator.

4. A pump in accordance with claim 3 further comprising:

a fan rotatably driven by the probe for blowing air at a temperature cooler than the brake into contact with a surface thermally coupled to the brake for cooling the brake.

5. A pump in accordance with claim 4 further comprising:

a heat exchanger coupled to air flowing to the fan and to the fluid outputted by the output for cooling the fluid outputted by the output.

6. A pump in accordance with claim 5 wherein:

the pump is a fuel pump for a propulsion engine in an airframe and the fluid is fuel having a coking temperature.

7. A pump in accordance with claim 3 wherein:

the pump is a fuel pump for a propulsion engine in an airframe and the fluid is fuel having a coking temperature.

8. A pump in accordance with claim 2 further comprising:

a fan rotatably driven by the probe for blowing air at a temperature cooler than the brake into contact with a surface thermally coupled to the brake for cooling the brake.

9. A pump in accordance with claim 8 wherein:

the pump is a fuel pump for a propulsion engine in an airframe and the fluid is fuel having a coking temperature.

10. A pump in accordance with claim 2 wherein:

the pump is a fuel pump for a propulsion engine in an airframe and the fluid is fuel having a coking temperature.

11. A pump in accordance with claim 1 wherein the stationary pump housing comprises:

a first section in which the brake is disposed;

a second section in which the fluid receiving chamber is disposed; and wherein the pitot probe is rotatably mounted in the first and second sections with the thermal insulator and the pitot probe defining a chamber extending radially from the probe to the insulator.

12. A pump in accordance with claim 11 further comprising:

a fan rotatably driven by the probe for blowing air at a temperature cooler than the brake into contact with a surface thermally coupled to the brake for cooling the brake.

13. A pump in accordance with claim 12 further comprising:

a heat exchanger coupled to air flowing to the fan and to the fluid outputted by the output for cooling the fluid outputted by the output.

14. A pump in accordance with claim 13 wherein:

the pump is a fuel pump for a propulsion engine in an airframe and the fluid is fuel having a coking temperature.

15. A pump in accordance with claim 11 wherein:

the pump is a fuel pump for a propulsion engine in an airframe and the fluid is fuel having a coking temperature.

16. A pump in accordance with claim 1 further comprising:

a fan rotatably driven by the probe for blowing air at a temperature cooler than the brake into contact with a surface thermally coupled to the brake for cooling the brake.

17. A pump in accordance with claim 16 further comprising:

a heat exchanger coupled to air flowing to the fan and to the fluid outputted by the output for cooling the fluid outputted by the output.

18. A pump in accordance with claim 17 wherein:

the pump is a fuel pump for a propulsion engine in an airframe and the fluid is fuel having a coking temperature.

19. A pump in accordance with claim 16 wherein:

the pump is a fuel pump for a propulsion engine in an airframe and the fluid is fuel having a coking temperature.

20. A pump in accordance with claim 8 further comprising:

a heat exchanger coupled to air flowing to the fan and to the fluid outputted by the output for cooling the fluid outputted by the output.

21. A pump in accordance with claim 20 wherein:

the pump is a fuel pump for a propulsion engine in an airframe and the fluid is fuel having a coking temperature.

22. A pump in accordance with claim 1 wherein:

the pump is a fuel pump for a propulsion engine in an airframe and the fluid is fuel having a coking temperature.

* * * * *